United States Patent [19]

Barbal

[11] 4,367,570

[45] Jan. 11, 1983

[54] AUTOMATICALLY DISENGAGABLE SAFETY BUCKLE ASSEMBLY

[76] Inventor: Andrew L. Barbal, 147-29 16th Rd., Whitestone, N.Y. 11357

[21] Appl. No.: 289,247

[22] Filed: Aug. 3, 1981

[51] Int. Cl.[3] ..... A43C 11/08

[52] U.S. Cl. ..... 24/230 R

[58] Field of Search ..... 24/230 R

[56] References Cited

U.S. PATENT DOCUMENTS

| | | | |
|---|---|---|---|
| 898,924 | 9/1908 | Reichert . | |
| 2,802,252 | 8/1957 | Gaylord | 24/241 SL |
| 3,225,406 | 12/1965 | Levy | 24/230 |
| 3,396,435 | 8/1968 | Davis | 24/230 R |
| 3,457,603 | 7/1969 | Romanzi | 24/241 R |

*Primary Examiner*—Gene Mancene
*Assistant Examiner*—Wenceslao J. Contreras
*Attorney, Agent, or Firm*—Robert D. Farkas

[57] ABSTRACT

An automatically disengagable safety buckle assembly utilizes a rod-like element having two free ends. The rod-like element is secured to one end of the flexible safety strap. A plate having a hook-like end is secured to one end of another flexible safety strap. The rod-like element is introduced between a spring-like sheet secured to the plate and another sheet that is spaced non-uniformly outwardly from the side of the plate carrying the hook. The rod-like element is permitted to slide along the spring-like sheet, after entry, to a dwell position which is defined by an outwardly disposed arcuate excursion in the surface of the other sheet. The apparatus is employed prior to impact with the rod-like element reposing in the dwell position. Upon impact, the rod-like element is displaced towards the hook of the plate and continues to restrain the user from unlimited forward travel. After the body finishes its rebound, the rod-like element is forced upwardly and outwardly from the hook of the plate by a ramp-like end of the spring-like sheet that is secured to the plate, causing the rod-like element to become disengaged from between the spring-like sheet, the other sheet and the plate, thus decoupling the rod-like element from the apparatus. An adjustment screw engaging the other sheet and the plate, may be utilized for reducing the tension in the other sheet, so that children may manually disengage the buckle assembly at will, thereby controlling the amount of force required to permit the C-shaped element to become disengaged from its dwell position.

9 Claims, 7 Drawing Figures

AUTOMATICALLY DISENGAGABLE SAFETY BUCKLE ASSEMBLY

BACKGROUND OF THE INVENTION

1. The Field of the Invention

This invention relates to buckle assembly and more particularly to that class which automatically disengages the ends of a pair of straps upon a sufficient tensional force being exerted thereupon.

2. Description of the Prior Art

The prior art abounds with safety buckle devices primarily intended for use in motor vehicles. My U.S. Pat. No. 4,075,741, issued Feb. 25, 1978, describes an apparatus which includes a C-shaped rod which is secured in a dwell position, and when released therefrom, upon sufficient force being exerted on such C-shaped rod, escapes from confinement between a surface of a sheet and a plate having a hook-like end. Such apparatus utilizes a spring secured to the plate on an outermost surface thereof, having its hook-like end passing through a pair of openings in the plate. Further, such apparatus does not include means for adjusting the tension in the sheet relative to the plate, thereby precluding easy detachment of the device by children. Further, my invention, described in the aforementioned patent, is limited to a device which cannot be housed. The two slots, on opposite ends of the invention, adapted to receive the free ends of the C-shaped rod may capture portions of clothing or other fabric-like elements.

SUMMARY OF THE INVENTION

A primary object of the present invention is to provide a safety buckle for use on seat belts in motor vehicles which successfully and securely captures the user within the confines of the belts during the occurrence of a collision, automatically releasing the user from an encircled condition instantly after the occurrence of an impact and after the body rebounds.

Another object of the present invention is to provide a safety buckle which may be adjusted in usage, such that small children may release themselves manually, in normal non-impact usage. In impact situations, children and adults are released automatically, with equal facility.

Still another object of the present invention is to provide a safety belt buckle assembly which may have the buckling elements thereof positioned in a dwell or normal usage location, such that the elements will not accidentally open, unless there is an impact or unless the user desires to open such elements, separating them.

Yet another object of the present invention is to provide a buckle arrangement in accordance with the preceding objects which is substantially inexpensive in manufacture, suitable for its intended purpose, and extremely durable in construction.

Still another object of the present invention is to provide a safety buckle which allows its slidable elements to be smoothly engaged with one another until disengagement.

Heretofore, buckle attachments for seat belts in motor vehicles required a manually operated force through the buckle device in order to either disengage the user from confinement within the belts thereof, or required a complex and difficult manipulation of the buckle elements in order to release the user from such confinement. Today, many potential seat belt users continue to refuse to wear seat belts because of their fear of being trapped within a vehicle after the occurrence of an impact, such fear being heightened by the possibility of fire occuring following the impact. Additionally, many users feel that a seat belt, if continued in its restraining action upon them, in the event they become unconscious or otherwise disabled, following an impact, substantially increases the length of time in which such user may be extracted from a vehicle, when unable to emerge from the vehicle without external assistance from others. Further, many users fear the use of seat buckle arrangements which tend to confine individuals or small children, because of their inability, because of age, infirmity or other factors, to quickly and expeditiously unfasten the belt, when required to do so rapidly. Finally, many users are opposed to utilizing seat belts which are difficult to assemble the elements thereof together and, fear to utilize seat belts that may have the elements thereof accidentally disengaged when no impact occurs.

The present invention contemplates these problems and solves them by providing a buckle apparatus which maintains the flexible straps to which they are secured joined together during impact and disengaging such elements automatically after impact, as well as providing an apparatus which may be easily used by children and adults. Further, by the location of the various elements comprising the apparatus, sharp edges are avoided and the elements that are fastened together, to be released on impact or at the will of the user, are retained in the dwell or normal use position securely. Most importantly, the present invention is functionally tested each time the belt is put on and taken off. Quite often, safety devices, such as air bags or the like, are called on for their task only once in a rare while. On those occasions when such devices are required, they may fail when most needed. The present invention, because of its peculiar construction and features, is tested each time it is encircled about the waist of the user, thereby assuring that on those rare occasions that the apparatus is, in fact, required to be in operating condition, the apparatus is in good working order. The present invention contemplates a smoothly traveling C-shaped or T-shaped rod-like element, traveling along the surface of a spring-like sheet at all times. This assures smooth ejection capability of the rod-like element at the hook-like end of the plate.

These objects as well as other objects of the present invention, will become more readily apparent after reading the following description of the accompanying drawings.

DESCRIPTION OF THE PREFERRED EMBODIMENT

Figure 1:
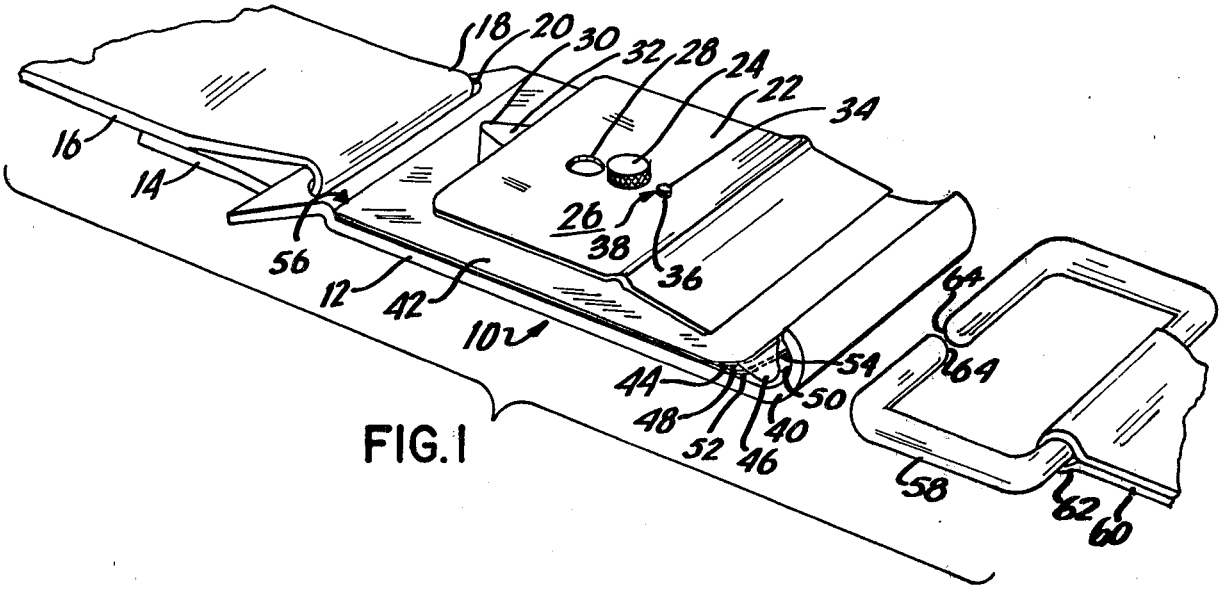
FIG. 1 is a perspective view of the present invention.

The structure and method of fabrication of the present invention is applicable to a C-shaped rod-like element pivotably secured to one end of the first strap of a seat belt apparatus installed in a motor vehicle, as shown in my U.S. Pat. No. 4,075,741, issued Feb. 28, 1978. The free ends of the rod-like element are disposed directed towards each other and are separated by a fixed distance. Such free ends have a rounded-like shape for a purpose that will be later seen. A plate-like element is provided having a hook-like surface formed at one end thereof. The other end of the plate is adapted with an extended slot, extending transverse to the length of the plate, to which an end of a second seat belt strap is secured. A bar is fastened to the surface of the plate, carrying the hook-like end, and extends simply between the hook-like end and the slotted end thereof. The bar is pointed closest to the slotted end of the plate and has a ramped exterior surface adjacent the other end of the bar directed inwardly towards the surface of the plate carrying the concave portion of the hook end of the plate. A first spring steel element is secured to the side of the plate, having the concave portion of the hook, and is located between the bar and the plate. The end of the first spring element is provided having a free portion bent upwardly and outwardly from the extended lateral surface of the plate having the concave surface of the hook-like end thereof. The other end of the first spring element may, if desired, extend to and into the elongated slot in which the second seat belt strap is secured, in order to minimize interference when loading the C-shaped rod onto the exposed surface of the first spring steel element. The free ends of the first spring sheet element are disposed extending downwardly, on opposed sides of such first spring steel sheet elements in the region of the concave portion of the hook-like end, so as to shield the introduction of fine matter, such as fingers or the like, from passage into the space between the end of the first spring-like element that extends upwardly and outwardly from the plate and the concave surface of the hook-like end of the plate. A second spring steel sheet-like element may be interposed intermediate the first spring steel element and the plate, having the end closest to the hook-like end of the plate extending upwardly and outwardly from the lateral surface of the second spring-like element so as to reinforce the spring action provided the incline surface at the free end of the first spring-like element providing a "follow-through" action, much like that seen when striking a golf ball with a golf club. At a location intermediate a position defined as the dwell position, in my U.S. Pat. No. 4,075,741, is a flat-headed rivet, whose flattened ends extend outwardly from opposite sides of the bar. Such flat-headed rivet provides an interference fit between the rounded ends of the C-shaped rod, when the rod is caused to pass over and beyond such flat-headed rivet. Some, but not considerable, force is required to move the C-shaped rod past the location of the flat-headed rivet and into the dwell position, thereby tending to prevent the ability of the apparatus elements, namely the C-shaped rod and the balance of the assembly, to become disengaged, by passing the C-shaped rod back through the positions taken thereby when first installing the C-shaped rod into the dwell position.

Once in the dwell position, the C-shaped rod is secured thereby and retained therein by the arcuate shape of another spring-like steel sheet that is secured to a portion of the bar opposite the plate-like element. A portion of such spring-like steel sheet resides in touching engagement with the outermost surface of the bar, whilst the remaining portions of such sheet may be disposed upwardly from ramped portions of the bar. An adjustment screw, preferably having a knurled head, passes through an opening in such sheet, and has its threaded portion engaged in threading engagement with a threaded hole in the bar. Turning such adjustment screw, say ½ turn to the left, adjusts the tension in such spring-like steel sheet, so that children, when wishing to manually disengage the buckel element can do so easily. Even if the adjustment screw is not turned to minimize the tension upon any impact, the force generated with a child encircled by the straps and buckle assembly, would be released instantly and automatically. The mid-portion of such retaining sheet is adapted with an arcuately-shaped notch extending outwardly from the lateral surface of the plate co-extensive concave surface of the hook, forming the location defined as the dwell position of the C-shaped rod-like element. The position of the flat-headed rivet, as defined by its diameter of the flat rivet head, located on opposite sides of the bar, are configured, in combination with the diameter of the free ends of the C-shaped rod-like elements, such that such free ends reside within the arcuately-shaped notch, thereby preventing the C-shaped rod-like element to be easily withdrawn towards the slotted end of the plate, thereby tending to coerce the user into removing the C-shaped rod-like element by pulling on same towards the hook-like end of the plate, thereby testing the apparatus each time it is utilized. Another rivet is installed securing the bar, the plate, the first spring element, the second spring element, and the retaining spring-like sheet. Still another aligning pin is secured to the plate, at a location close to the unpointed end of the bar. Such end passes through a smaller hole in the retaining sheet, thereby permitting the retaining sheet some freedom upwardly and downwardly in a portion thereof adjacent to hook-like end of the plate.

In use, the rod-like, C-shaped element is disposed touching the plate intermediate the slot therein and the wedge-shaped end of the bar. The rod-like element is then disposed sliding along the surface of the first spring-like element so as to have the rod-like free ends of the C-shaped element captured between adjacent faces of the retaining sheet and the first spring element. When the rod-like free end of the C-shaped element is disposed in contact with the flat ends of the double rivet, such C-element meets a moderate resisting force to further motion of the free ends of the C-shaped element. Upon exerting sufficient, though moderate force, to the C-shaped element, in the direction of hook-like end of the plate, such free ends override the interference encountered by the flat ends of the double-ended rivet. At a location adjacent the edges of the oval ends of the double-ended rivet, the retaining sheet arcuately disposed excursion reside. The free ends of the C-shaped element come into contact with the arcuate portion of the retaining sheet, so as to reside therein in a normal rest or dwell position. Should the user wish to disengage the C-shaped element from the plate assembly, the C-shaped element is manually disposed towards the hook-like end of the plate. Since the retaining sheet is ramped downwardly, at the end adjacent the hook-like end of the plate, a moderate but consistent amount of force must be applied to the C-shaped element, to dispose such element towards the hook-like end of the plate. Upon an impact, the rod-like element is forced to travel towards the hook end of the plate, lifting the inwardly directed portion of the retaining sheet upwardly and outwardly from its rest position. When sufficient force is applied, the free ends of the rod-like element come into touching engagement with the ramped free end of the first spring element, crossing such ramped free end to move downwardly into the hook-like end of the plate. The second spring-like element provides a separate and an additional force, supplemental to the force provided to the ramped end of the first spring element, and will be similarly nestled within the hook-like end for as long as a force is applied to the C-shaped element causing the ends of the C-shaped element to remain nestled within the hook-like end of the plate. Naturally, upon most impacts, a user will be thrown sufficiently forwardly or sidewardly so as to exert the requisite forces upon the hook-like end and the plate, in opposite directions, so as to cause the free ends of the C-shaped element to nestle within the hook-like end of the plate. Upon rebound or upon a cessation of such force, normally on rebound, the forces provided by the body of the user is relaxed, permitting the first spring element and the second spring element to urge the free ends of the C-shaped element upwardly and outwardly from the confines of the concave surface of the hook-like end so as to project the free ends of the C-shaped element outwardly from the outermost surface of the retaining element, thereby disengaging the rod-like element from the plate, freeing the user automatically from confinement between the straps.

An alternate embodiment of the present invention includes a housing-like covering, encircling a portion of the plate element, and having an elongated opening extending along the length of the housing. Two retaining elements are utilized, each mounted upon bars, such that the housing defines a T-shaped slot, having the two bars extending in opposed positions along the length of the slot. The housing is provided with an opening, adjacent the hook-like end of the plate. The C-shaped rod-like element is eliminated and replaced with a rod-like element whose active free end has a general T-like configuration. In use, the rounded opposed edges of the active ends of the T-shaped element is inserted into the end of the T-shaped passageway, located opposite to the end of the passageway adjacent the hooked end of the plate. The T-shaped element, coupled to its associated strap, is pulled manually to a dwell or rest position, defined by the location of two dimples or depressions found on opposed surfaces of the two bars. At such location, the free ends of the T-shaped rod-like element is retained in such position by the two retaining sheet elements secured to the bars. Each of the retaining sheet elements is provided having a downward offset, or ramp portion, restricting, though not prohibiting, the free motion of the free ends of the T-shaped rod-like element, in the direction of the hook end of the plate. As in the C-shaped rod-like element, the T-shaped rod-like element is positioned in a use position, so as to have the longitudinal axis of the "legs" of the T-shaped rod-like element extend slightly downwardly and inwardly from the longitudinal axis of the major surfaces of the plate. This is accomplished by a notch being disposed in the plate, in a central location, extending partially along the longitudinal axis thereof, from the hook end of the plate. The rounded ends of the free ends of the T-shaped element reside snugly, but releasably, in the dimples or depressions in opposed surfaces of the bars.

When sufficient force is encountered, such as by impact, or—if desired—by manual application of opposed forces, the T-shaped rod-like element travels towards the hook end of the plate, after being released from the dimples or semi-circular depressions in which they were retained, when in a normal use position. Upon engaging the upwardly curved portions of the uppermost outermost spring element, upon which the free ends of the T-shaped rod-like element is slidably engaged, such free ends are temporarily captured by the hook end of the plate, overcoming the ejection forces of the uppermost outermost spring-like element and the underlying second stage spring-like element, as well. When the force is automatically released, retaining the free ends of the T-shaped rod-like element in the hook end of the plate, the outermost spring element and the second stage or lowermost spring element operate on the free ends of the T-shaped element, causing it to automatically and instantly eject. The smooth integrated housing prevents accidental engagement of clothing or other articles within the buckle and provides a grasping surface, facilitating easy insertion and removal of the buckle elements.

Now referring to the figures, and more particularly, to the embodiment illustrated in FIG. 1 showing the present invention 10 utilizing plate 12 to which is affixed end 14 of flexible strap 16, utilizing bight 18 passing through slot 20. Retaining spring-like element 22 is shown having adjustment screw 24 extending above uppermost surface 26 thereof. Rivet 28 is shown adjacent wedge-shaped end 30 of bar 32 whilst free end 34 of aligning pin 36 is shown passing through hole 38 of outer surface 26. Hook-like end 40, of plate 12, is shown opposite the end thereof carrying slot 20. First spring element 42 is shown having a ramped-like end 44 thereof installed adjacent hook-like end 40 and is provided with a skirt portion 46 on edge 48 thereof. Another skirt portion, not shown, resides on an opposed edge, adjacent the other end of the hook-like end 40, protecting against the inadvertent inclusion of fingers and articles of apparel into cavity 50, formed by first spring-like element 42 and hook-like end 40. Another spring-like element 52 is shown having end 54 thereof residing intermediate end 44 of first spring-like element 42, both being inclined upwardly and outwardly from the lateral surface 56 of plate 12. C-shaped rod-like element 58 is shown secured to belt 60, utilizing bight 62 therefor. Ends 64 of rod-like element 58 are shown rounded and separated a finite distance apart.

Figure 2:
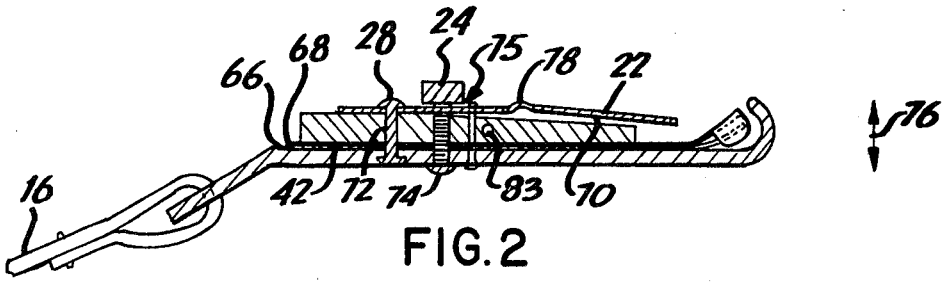
FIG. 2 is a side elevation cross-sectional view of a portion of the present invention.

FIG. 2 illustrates end 66, of first spring element 42, being disposed a fixed distance from slot 20, such that surface 68, of first spring element 42 is disposed opposite to lowermost surface 70, of retaining spring-steel element 22. Adjustment screw 24, is shown residing in threaded hole 72, such that the tension in retaining sheet element 22 may be varied as the adjustment screw moves upwardly and downwardly. The adjustment screw is caused to reside in one of its two positions, dependent upon the rotation of adjustment screw 24. Crowned end 74 of screw 24, when moving upwardly or downwardly, in the direction of arrows 76, is permitted to so move by virtue of clearance 74 located adjacent the grasping end of screw 24. Arcuately shaped portion 78, of retaining sheet 22, is shown adjacent the rivet 83.

Figure 3:
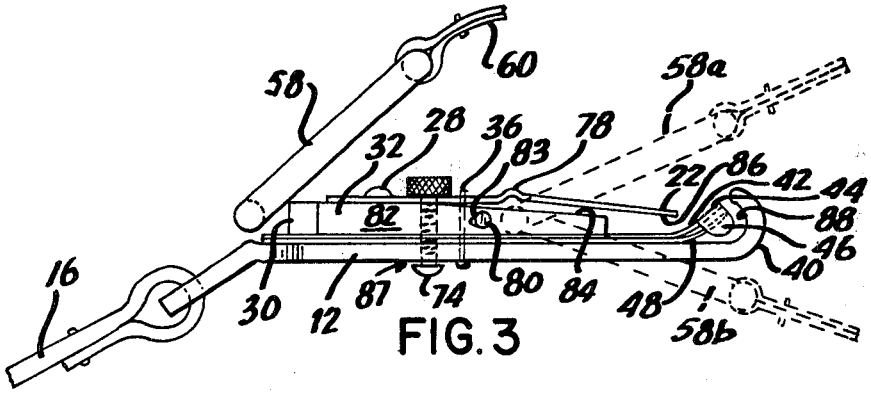
FIG. 3 is a side elevation view of the apparatus shown in FIG. 1.

FIG. 3 illustrates C-shaped rod-like element 58 in an insertion position adjacent end 30, of bar 32. One flat end 80 of double ended rivet 83, is shown adjacent excursion 78, in retaining element 22. Another end, not shown, resides on an opposite surface of bar 32, opposite to surface 82. Dotted lines 58*a* illustrate the position of C-shaped rod-like element 58, when ends 64 thereof, shown in FIG. 1, are disposed in the dwell position, adjacent excursion 78, when moved upwardly and outwardly from the normal use position, shown by dotted lines 58*b*. Ramped surface 84, of bar 32, is disposed separated a small distance from surface 86, of sheet-like element 22. Upon suitable adjustment of adjustment screw 24, space 75, shown in FIG. 2, is closed and space 87 is opened. In this condition, the tension is maximized on sheet 22, and the buckle is suitable for adults' use. Flange-like or skirt-like ends 46 of the first spring-like element 42, are shown residing adjacent the concave surface 88, of hook-like end 40. Such skirt-like portions reside slightly outwardly from the marginal edges of plate 12 such that no elements, other than 48, may be confined within the interior surface 88, of hook-like end 40, and ramped-like end 44 of first spring-like element 42. I have discovered that providing ramped-like end 44, of first spring-like element 42, at an angle of some 45 to 50 degrees, outwardly and above from the lateral surface of the extended portion of spring-like element 42, works most satisfactorily whilst the ramp-like end 54, shown in dotted lines, for the second spring-like element, if desired, may extend at a slightly lesser angle separated from and located in between ramp-like end 44 and surface 88.

Figure 4:
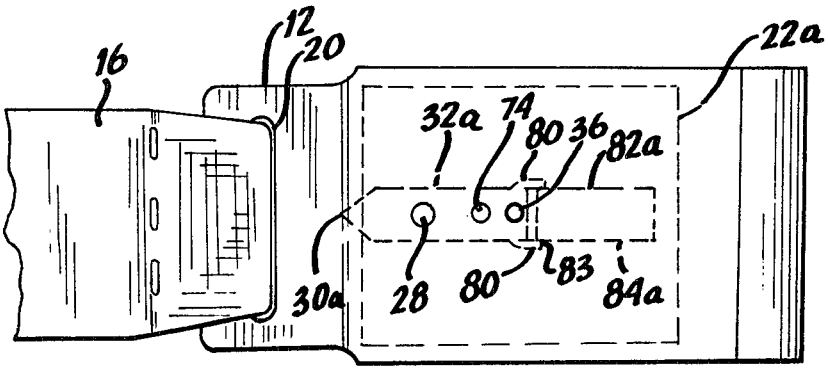
FIG. 4 is a bottom view of a portion of the apparatus shown in FIG. 1.

FIG. 4 illustrates a bottom view of plate element 12, showing elongated slot 20 therein. Wedge-shaped end 30*a*, shown in dotted lines, in disposed adjacent slot 20, and is located at the adjacent end of bar 32*a*, also shown in dotted lines. Crowned end 74, of screw 24, is clearly defined located intermediate rivet 28 and aligned pin 36. Ends 80, of rivet 83 are used for making an interference fit the ends 64, shown in FIG. 1, and are shown having flat head, stud-like ends 80 extending outwardly from opposite surfaces 82*a* and 84*a* of bar 32*a*. Dotted lines 22*a* simulate the retaining sheet 22, shown in FIG. 1.

Figure 5:
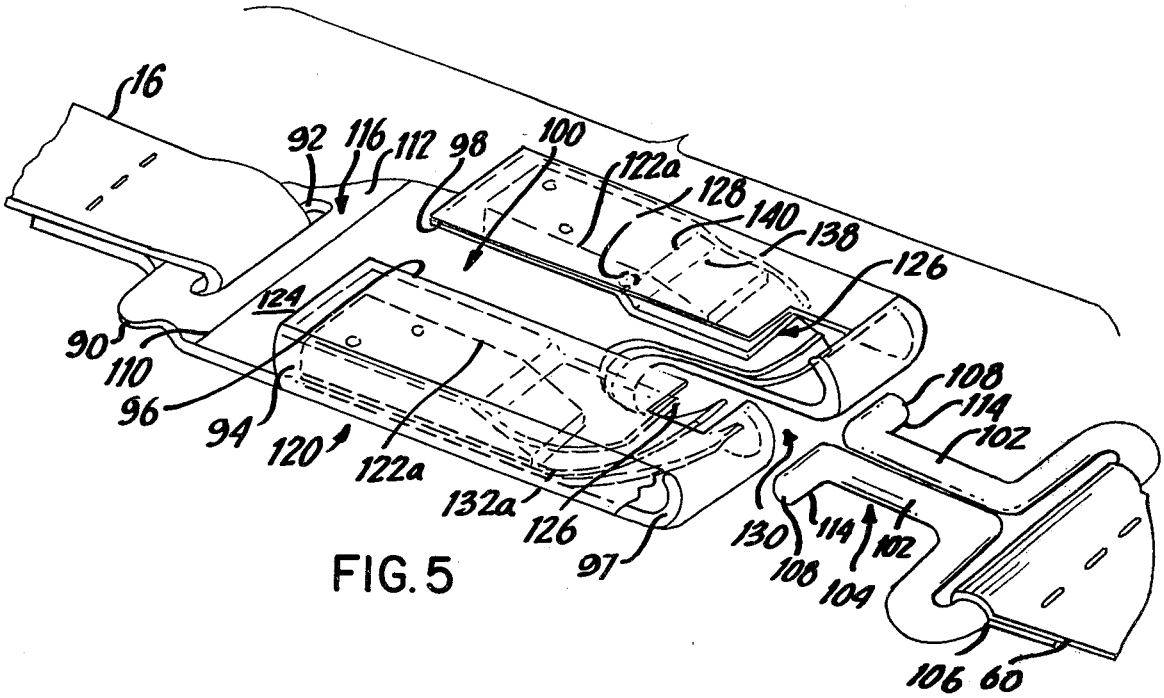
FIG. 5 is a perspective view of an alternate embodiment of the present invention.

FIG. 5 illustrates an alternate embodiment of the present invention utilizing plate 90, shown having strap 16 engaged within slot 92, of plate 90. Housing 94 is shown engaging a portion of plate 90, including the outermost edges of hook-like end 97 of plate 90. End 97 and 98, of housing 94, define opening 100, through which "leg" portions 102, of T-shaped rod-like element 104, may pass. Strap 60 is connected to T-shaped element 104, by use of bight 106 thereof. Free ends 108, directed in opposite directions of T-shaped element 104, are shown rounded. First spring steel element 110 is secured to uppermost surface 112, of plate 90. Free ends 114, of T-shaped element 104, are configured to firstly rest at end 116 of first spring element 110, when T-shaped element 104 is to be assembled to buckle embodiment 120. Dotted lines 122*a* define two bars, each engaging surface 124 of first spring element 110. Retaining sheets 126 are disposed intermediate housing 94 and the uppermost surfaces of bars 122*a*. A dimple, or depression, shown by dotted lines 128, resides in the vertical side wall of bar 122*a*, as shown. The other bar is similarly equipped with a semi-spherical depression or dimple, in an opposed location, both dimples being adapted to receive therein rounded ends 108, of T-shaped rod-like element 104. Slot 130 extends partially along the longitudinal axis of plate 90, as well as partially along the length of first spring element 110, and the second spring element, shown by solid line 132 and by dotted lines 132*a*. First and second spring elements 110 and 132 are each provided having arcuately-shaped portions disposed adjacent hook-like end 97 of plate 90.

Figure 6:
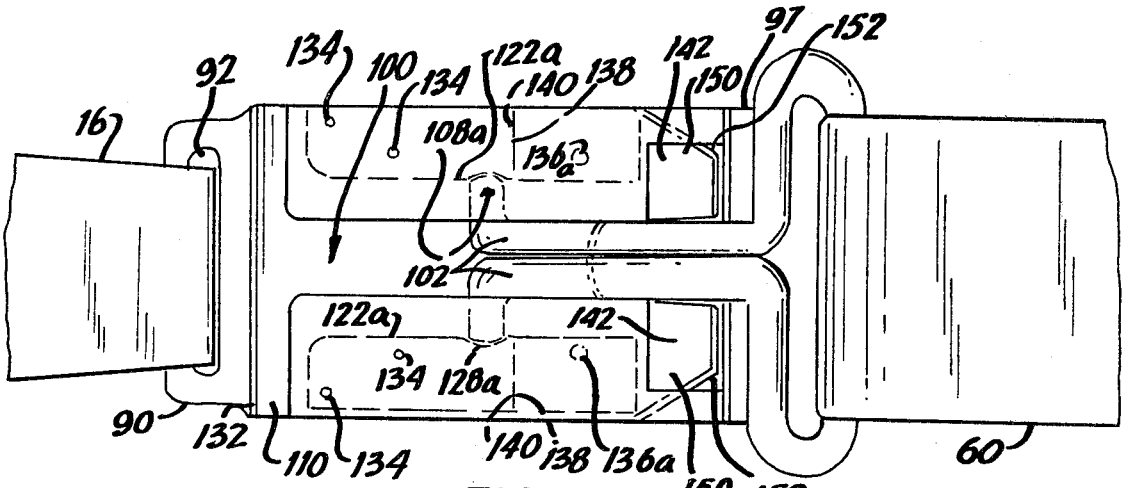
FIG. 6 is a plan view of the apparatus shown in FIG. 5.

FIG. 6 indicates rivets 134 which secure housing 94, the bars shown by dotted lines 122*a*, first spring element 110, shown disposed over second spring element 132 and plate 90, together. Dotted lines 136*a* indicate a rivet, utilized to secure the ramped portion of bars 122*a* to spring elements 110, and 132, as well as plate 90. It should be noted that the rivets depicted by dotted lines 136*a* do not pass through retaining sheet elements 126, shown in FIG. 1. Dotted lines 138 and 140 depict the bend portions of retaining sheets 126, as shown in FIG. 5. Semi-spherical depressions 128, shown in FIG. 5, are shown in FIG. 6 by dotted lines 128*a*. Openings 142, in passageway 100, located adjacent hook end 97 of plate 90, permit ends 114 to be ejected outwardly therethrough, because of the spring action of the arcuately-shaped ends 150 and 152 of spring elements 110 and 132 respectively.

Figure 7:
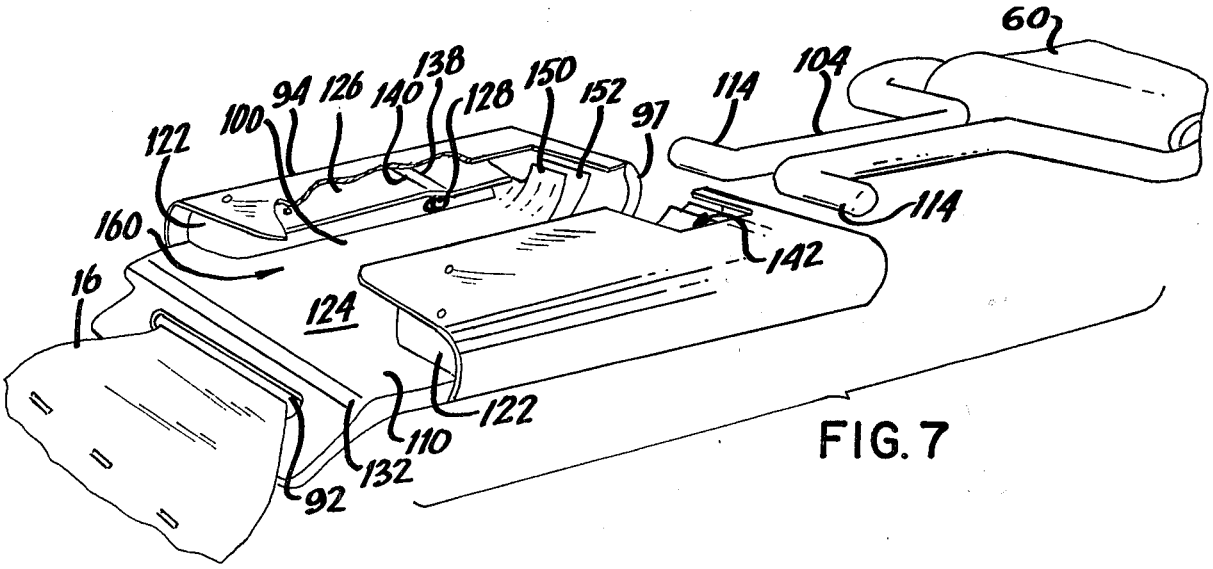
FIG. 7 is another perspective view of the apparatus shown in FIG. 5.

FIG. 7 illustrates retaining sheet 126, showing bends 140 and 138 therein. Semi-hemispherical depression 128 may be seen located nearest entraceway 160, of passageway 100, than are bends 140 and 138.

As can be seen, the present invention includes the first spring element being disposed on a side of the plate element, having the hook-like end, wherein the concave portion is coextensive with the lateral surfaces of such first spring-like element. Further, such first spring-like element is provided with skirt-like, flange-like portions protecting against sharp edges and pinching effects upon the operation of the apparatus. Additionally, the double-headed rivet 83 is provided, facilitating difficulty in removal of the C-shaped rod-like element in the direction of joining such element to the plate-like apparatus of the invention. Additionally, the retaining sheet is provided with a two position adjustment whereby less force, in one position, it utilized to remove the C-shaped rod-like element from engagement with the plate element, by a child thereby providing greater flexibility in use.

The alternate embodiment of the present invention also includes the first spring-like element being disposed on the side of the plate element such that the free ends of the T-shaped rod-like element may slide easily along the length thereof until the rounded ends of the T-shaped element engage the dimple-like depressions in a use condition. Upon releasing the free ends of the T-shaped element from its normal retained location, as by insertion in the depressions, the free ends of the T-like element continues to smoothly ride upon the same exposed surface of the first spring element. In this embodiment, the first spring-like element need not employ the skirt-like flange-like portions since the edges of the first spring-like element and the underlying second stage spring-like element are protected by a housing.

One of the advantages of the present invention is a safety buckle for use on seat belts in motor vehicles which successfully and securely captures the user within the confines of the belts during the occurrence of a collision, automatically releasing the user from an encircled condition instantly after the occurrence of an impact.

Another advantage of the present invention is a safety buckle which may be adjusted in usage, such that small children may release themselves manually, in normal non-impact usage. In impact situations, children and adults are released automatically, with equal facility.

Still another advantage of the present invention is a safety belt buckle assembly which may have the buckling elements thereof positioned in a dwell or normal usage location, such that the elements will not accidentally open, unless there is an impact or unless the user desires to open such elements, separating them.

Yet another advantage of the present invention is a buckle arrangement in accordance with the preceding objects which is substantially inexpensive in manufacture, suitable for its intended purpose, and extremely durable in construction.

Still another advantage of the present invention is a safety buckle which allows its slidable elements to be smoothly engaged with one another until disengagement.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. An automatically disengagable safety buckle apparatus comprising a plate, one end of said plate having a hook-like shape, the other end of said plate being secured to one end of a first flexible strap, a rod-like element, said rod-like element having a pair of free ends, said pair of free ends being disposed in opposite directions, said pair of free ends each having generally a rounded shape, a second flexible strap, said second flexible strap being secured to said rod-like element, a first resilient spring-like member, said first resilient spring-like member being disposed secured to a first lateral surface of said plate, said first lateral surface of said plate being co-extensive with the concave portions of said hook-like end, said first resilient spring-like member having one end thereof extending upwardly and outwardly from said lateral surface of said plate and residing adjacent said hook-like end, at least one retaining sheet, said retaining sheet being disposed fixedly secured at least along a portion thereof to said plate, said at least one retaining sheet being disposed spaced outwardly from a lateral surface of said first spring-like member, and said lateral surface of said plate, said at least one retaining sheet having one end thereof disposed a greater distance from said first resilient spring-like member than the other end thereof, means to slidably engage said pair of free ends of said rod-like element along at least a portion of said first resilient spring-like member and said at least one retaining sheet, at least one bar, said at least one bar being disposed intermediate said at least one retaining sheet and said first resilient spring-like member, means to releasably restrain the free travel of said pair of free ends of said rod-like member along the length of said at least one bar and at one point along the length thereof.

2. The apparatus as claimed in claim 1 wherein said rod-like element comprises a C-shaped rod.

3. The apparatus as claimed in claim 1 wherein said first resilient spring-like member carries a pair of tab-like wings disposed adjacent said one end thereof.

4. The apparatus as claimed in claim 1 comprising said releasably restraining means being a double-headed rivet, said double-headed rivet having a pair of free ends, each of said pair of free ends of said double-headed rivet having a portion thereof flattened.

5. The apparatus as claimed in claim 1 further comprising a second resilient spring-like member, said second resilient spring-like member being disposed intermediate said first resilient spring-like member and said plate, said second resilient spring-like member having one end thereof extending upwardly and outwardly from said lateral surface of said plate.

6. The apparatus as claimed in claim 1 further comprising a housing, said housing having an elongated passageway extending along the length of said housing, the longitudinal axis of said elongated passageway extending substantially parallel to a longitudinal axis of said plate, said housing partially encircling said plate, at least a portion of said first resilient spring-like member being disposed within said housing, said at least one bar carrying a semi-spherical depression therein, said at least one retaining sheet being two in number, said elongated passageway having a width greater at one end thereof than at the other end thereof, said width of said passageway being greater than the width of the remaining portions of said passageway at a location adjacent said hook-like end of said plate.

7. The apparatus as claimed in claim 6 further comprising said plate having an elongated notch extending along a portion of the length thereof, said first resilient spring-like member having a notch therein, said notch of said first resilient spring-like member being disposed juxtaposed over said notch in said plate.

8. The apparatus as claimed in claim 6 further comprising a second resilient spring-like member, said second resilient spring-like member being disposed intermediate said first resilient spring-like member and said plate, said second resilient spring-like member having a notch therein.

9. The apparatus as claimed in claim 1 further comprising a threaded screw, one end of said threaded screw being disposed outwardly from said retaining sheet, said threaded screw being threadingly engaged with said bar, the other end of said threaded screw extending outwardly from an opposed lateral surface of said lateral surface of said plate, means to limit the travel of said threaded screw.

* * * * *